US008601612B2

(12) United States Patent
Funk-Danielson

(10) Patent No.: US 8,601,612 B2
(45) Date of Patent: Dec. 10, 2013

(54) OVERLAPPING ELEMENT

(75) Inventor: Brenda K. Funk-Danielson, Portland, OR (US)

(73) Assignee: Nike, Inc., Beaverton, OR (US)

( * ) Notice: Subject to any disclaimer, the term of this patent is extended or adjusted under 35 U.S.C. 154(b) by 2616 days.

(21) Appl. No.: 10/845,479

(22) Filed: May 14, 2004

(65) Prior Publication Data

US 2005/0252119 A1 Nov. 17, 2005

(51) Int. Cl.
*A41B 1/08* (2006.01)
*A41D 27/10* (2006.01)

(52) U.S. Cl.
USPC ..... 2/125; 2/97; 2/DIG. 2; 2/123

(58) Field of Classification Search
USPC ..... 2/108, 97, 93, 272, 164, 190, DIG. 2, 2/123, 46, 51, 125, 270
See application file for complete search history.

(56) References Cited

U.S. PATENT DOCUMENTS

| | | | | |
|---|---|---|---|---|
| 176,185 | A * | 4/1876 | Levy et al. | 24/48 |
| 2,447,989 | A * | 8/1948 | Previdi | 2/125 |
| 2,736,900 | A | 10/1954 | Koren | |
| 2,758,310 | A | 8/1956 | Lewis et al. | |
| 3,122,306 | A | 2/1964 | Davey | |
| 3,462,764 | A | 8/1969 | Caster | |
| 4,353,362 | A | 10/1982 | DeMarco et al. | |
| 4,724,831 | A | 2/1988 | Huntjens | |
| 4,773,100 | A * | 9/1988 | Kuo | 2/46 |
| 5,046,662 | A | 9/1991 | Cowles | |
| 5,083,315 | A * | 1/1992 | Dillon, Jr. | 2/51 |
| 5,090,058 | A * | 2/1992 | Gerber | 2/97 |
| 5,093,934 | A * | 3/1992 | Dillon, Jr. | 2/105 |
| 5,289,960 | A | 3/1994 | Kelly et al. | |
| 5,504,944 | A | 4/1996 | Bromer et al. | |
| 5,784,720 | A | 7/1998 | Mellon et al. | |
| 5,988,468 | A | 11/1999 | Murdoch et al. | |
| 6,035,441 | A | 3/2000 | Mellon et al. | |
| 6,249,916 | B1 | 6/2001 | Mellon et al. | |
| 6,405,379 | B1 * | 6/2002 | Kelly | 2/123 |

FOREIGN PATENT DOCUMENTS

| | | |
|---|---|---|
| CH | 678597 | 10/1991 |
| DE | 297 09 220 | 8/1997 |
| FR | 1009973 | 6/1952 |
| FR | 2662361 | 11/1991 |

(Continued)

OTHER PUBLICATIONS

International Search Report in corresponding PCT application, international application No. PCT/US2005/016591, mailed Dec. 22, 2005.

(Continued)

*Primary Examiner* — Chi Q Nguyen
(74) *Attorney, Agent, or Firm* — Banner & Witcoff, Ltd.

(57) ABSTRACT

An element for an article of apparel, a container, or a variety of other products is disclosed. The element is formed from at least one section of a two-dimensional material, and the element includes a first edge and a second edge that each exhibit a concave configuration. Portions of the material adjacent the first edge and the second edge are arranged to overlap each other such that: (a) a portion of the first edge overlaps a portion of the second edge and (b) another portion of the second edge overlaps another portion of the first edge. The element may be utilized as a joint or a pocket in the article of apparel, and the element may form a pocket in the container.

23 Claims, 16 Drawing Sheets

(56) References Cited

FOREIGN PATENT DOCUMENTS

| | | | |
|---|---|---|---|
| GB | 583547 | A | 12/1946 |
| JP | S57-188804 | U | 11/1982 |
| JP | S59-129817 | U | 8/1984 |
| JP | 3029685 | U | 10/1996 |
| JP | 2001020111 | | 1/2001 |
| JP | 2002-088534 | A | 3/2002 |
| JP | 2002-180312 | A | 6/2002 |
| JP | 2004-332125 | A | 11/2004 |
| WO | WO 86/00505 | | 1/1986 |

OTHER PUBLICATIONS

Partial Search Report with Invitation to Pay Additional Fees in Corresponding PCT Case, PCT Application No. PCT/US2005/016591, mailed Sep. 16, 2005.
Notice of Reasons for Rejection for Japanese patent application No. 2007-513348 mailed Aug. 12, 2009.
Notice of Reasons for Rejection for Japanese patent application No. 2007-513348 mailed May 17, 2010.
Decision of Rejection for Japanese patent application No. 2007-513348 mailed Jan. 24, 2011.
Text of the First Office Action for Chinese patent application No. 200580014630.3 mailed Jan. 16, 2009.
Text of the Second Office Action for Chinese patent application No. 200580014630.3 mailed Jul. 13, 2010.
Text of the Third Office Action for Chinese patent application No. 200580014630.3 mailed Jul. 20, 2011.
Office Action received in Canadian patent application No. 2,563,050 mailed Aug. 28, 2008.
Notice of Allowance for Canadian patent application No. 2,563,050 mailed Jun. 22, 2009.
Examiner's first report on Australian patent application No. 2005244825 mailed Nov. 11, 2008.
Notice of Acceptance for Australian patent application No. 2005244825 mailed Dec. 10, 2009.
Office Action received in European patent application No. 05 749 630.9 mailed Jun. 26, 2008.
Decision to Grant for European patent application No. 05749630.9 mailed Sep. 23, 2010.
First Office Action for Tiawan patent application No. 94112556 mailed Jun. 9, 2006.
Notice of Allowance for Tiawan patent application No. 94112556 mailed Feb. 14, 2007.
Office Action received in Canadian patent application No. 2,688,913 mailed Aug. 21, 2012.
Notice of Allowance for Canadian patent application No. 2,688,913 mailed Apr. 16, 2013.
Patent Examination Report No. 1 for Australian patent application No. 2010201116 mailed Jun. 29, 2012.
Notice of Acceptance for Australian patent application No. 2010201116 mailed Nov. 5, 2012.
European Search Report for patent application No. 10170184.5 mailed Sep. 3, 2010.
Decision to Grant for European patent application No. 10170184.5 mailed Oct. 7, 2011.
European Search Report for patent application No. 10178887 mailed Oct. 29, 2010.
Decision to Grant for European patent application No. 10178887.5 mailed May 18, 2012.
The First Office Action for Chinese patent application No. 201110327536.0 mailed May 30, 2013.
Notice of Reasons for Rejection for Japanese patent application No. 2009-258455 mailed Dec. 26, 2011.
Notice of Reasons for Rejection for Japanese patent application No. 2009-258455 mailed Aug. 23, 2013.

* cited by examiner

OVERLAPPING ELEMENT

BACKGROUND OF THE INVENTION

1. Field of the Invention

The present invention relates to an overlapping element that is formed from a generally two-dimensional material and may be incorporated into a variety of structures, including an article of apparel. The invention concerns, more particularly, an element having at least two edges that overlap each other to form, for example, a flexible joint or a pocket in the article of apparel.

2. Description of Background Art

Various conventional articles of apparel include areas that are intended to bend or otherwise flex with movement of the human body. With regard to a shirt, for example, arm regions are often intended to accommodate bending of the elbow and movement of the shoulder. Similarly, the leg regions of a pair of pants are also intended to accommodate movement of legs, which includes ambulatory motions and bending of the knees. Despite the fact that conventional articles of apparel are intended to bend or otherwise flex with movement of the human body, some conventional articles of apparel restrict movement.

SUMMARY OF THE INVENTION

The present invention is an element that may be incorporated into an article of apparel, for example, to enhance flexibility in specific areas. In one aspect of the invention, the element is formed from at least one two-dimensional material, and the element includes a first edge and a second edge that each exhibit a concave configuration. Portions of the material adjacent the first edge and the second edge are arranged to overlap each other such that a portion of the first edge overlaps a portion of the second edge, and another portion of the second edge overlaps another portion of the first edge.

In one aspect of the invention, the first edge and the second edge are edges of a single section of the material. For example, the first edge and the second edge may be opposite edges of the single section of the material. In order to provide the overlapping configuration, the single section of the material is folded to locate the first edge and the second edge adjacent to each other. In addition to the first edge and the second edge, the material may include a pair of side edges that extend between the first edge and the second edge, and a portion of each side edge that is adjacent the first edge is joined with a portion of each side edge that is adjacent the second edge. In another aspect of the invention, the first edge and the second edge are formed in two different sections of the material that each include a pair of side edges.

The element may form a portion of an article of apparel. In some embodiments, the element is a flexible joint in the article of apparel, such as a joint in an elbow region or a knee region. The element may also be a pocket or a hand-receiving portion of the apparel. In addition to apparel, the element may form an opening, such as a pocket, in a container for receiving and securing objects.

The advantages and features of novelty characterizing the present invention are pointed out with particularity in the appended claims. To gain an improved understanding of the advantages and features of novelty, however, reference may be made to the following descriptive matter and accompanying drawings that describe and illustrate various embodiments and concepts related to the invention.

DESCRIPTION OF THE DRAWINGS

The foregoing Summary of the Invention, as well as the following Detailed Description of the Invention, will be better understood when read in conjunction with the accompanying drawings.

DETAILED DESCRIPTION OF THE INVENTION

The following discussion and accompanying figures disclose various overlapping elements that may be incorporated into an article of apparel. In general, the overlapping elements have at least two edges that overlap each other to form, for example, a flexible joint or a pocket in the article of apparel. In addition to an article of apparel, the overlapping elements may be incorporated into other products, such as a container (i.e., a backpack, hand bag, or duffel bag). Accordingly, the overlapping elements may be incorporated into a variety of products.

The overlapping elements are formed from a flexible and generally two-dimensional material. As utilized with respect to the present invention, the term "two-dimensional material"

is intended to encompass generally flat materials exhibiting a length and a width that are substantially greater than a thickness. Accordingly, suitable materials for the overlapping elements include various textiles and polymer sheets, for example. Textiles are generally manufactured from fibers, filaments, or yarns that are, for example, either (a) produced directly from webs of fibers by bonding, fusing, or interlocking to construct non-woven fabrics and felts or (b) formed through a mechanical manipulation of yarn to produce a woven fabric. The textiles may incorporate fibers that are arranged to impart one-directional stretch or multi-directional stretch. The polymer sheets may be extruded, rolled, or otherwise formed from a polymer material to exhibit a generally flat aspect. In addition to textiles and polymer sheets, other two-dimensional materials may be incorporated into the overlapping elements.

First Overlapping Element Configuration

Figure 1:
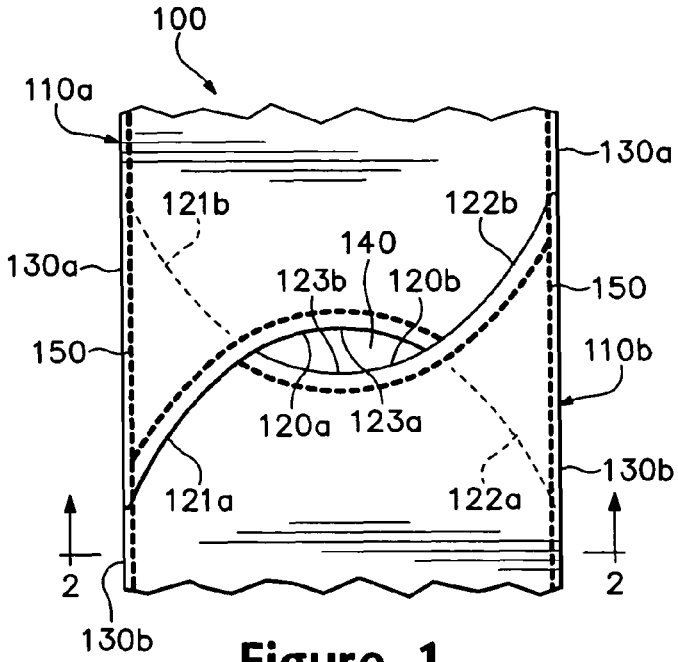
FIG. 1 is a plan view of a first overlapping element in accordance with the present invention.
Figure 2:
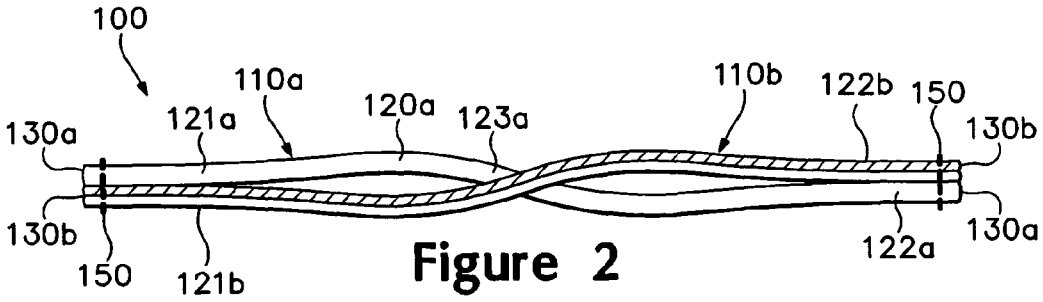
FIG. 2 is a first cross-sectional view of the first overlapping element, as defined by section line 2-2 in FIG. 1.
Figure 3:
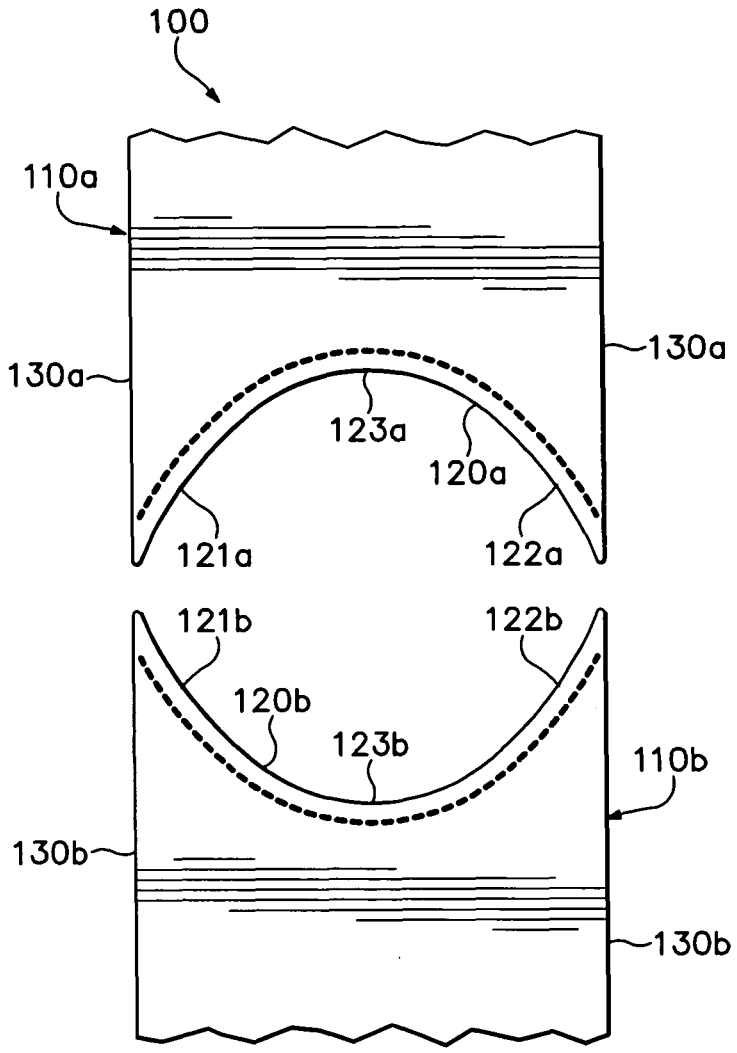
FIG. 3 is an exploded plan view of the first overlapping element.

A first overlapping element 100 is depicted in FIGS. 1-3 and includes a first section 110*a* and a second section 110*b* that are each formed from a two-dimensional material or two different two-dimensional materials. First section 110*a* includes a concave edge 120*a* and a pair of side edges 130*a*. At least a portion of concave edge 120*a* exhibits a concave configuration that effectively forms a depression in first section 110*a*. As depicted in the figures, concave edge 120*a* has a generally curved shape, but may also have an angular shape within the scope of the present invention. Concave edge 120*a* may, therefore, form a triangular or rectangular depression, for example, in first section 110*a*. Accordingly, the specific shape of concave edge 120*a* may vary significantly to encompass a variety of generally concave configurations, whether curved or angular. Concave edge 120*a* includes an end area 121*a*, another end area 122*a* that is positioned opposite end area 121*a*, and a central area 123*a* that is positioned between end areas 121*a* and 122*a*. End areas 121*a* and 122*a* are each located adjacent one of side edges 130*a*, but may also be spaced inward from side edges 130*a*. Side edges 130*a* extend away from concave edge 120*a* to effectively form sides of first section 110*a*.

Second section 110*b* exhibits a configuration that is substantially similar to first section 110*a*. Accordingly, second section 110*b* includes a concave edge 120*b* and a pair of side edges 130*b*. At least a portion of concave edge 120*b* exhibits a concave configuration that effectively forms a depression in second section 110*b*. The specific shape of concave edge 120*b* may be the same as concave edge 120*a*, or the shape may be different. Concave edge 120*b* includes an end area 121*b*, another end area 122*b* that is positioned opposite end area 121*b*, and a central area 123*b* that is positioned between end areas 121*b* and 122*b*. End areas 121*b* and 122*b* are each located adjacent one of side edges 130*b*, but may also be spaced inward from side edges 130*b*. Side edges 130*b* extend away from concave edge 120*b* to effectively form sides of second section 110*b*.

Overlapping element 100 is formed such that first section 110*a* and second section 110*b* overlap each other. More particularly, a portion of first section 110*a* overlaps a portion of second section 110*b*, and another portion of second section 110*b* overlaps another portion of first section 110*a*. Referring to FIGS. 1-3, for example, portions of the two-dimensional material adjacent concave edge 120*a* and concave edge 120*b* are arranged to contact and overlap each other such that a portion of concave edge 120*a* (i.e., end area 121*a*) overlaps a portion of concave edge 120*b* (i.e., end area 121*b*), and another portion of concave edge 120*b* (i.e., end area 122*b*) overlaps another portion of concave edge 120*a* (i.e., end area 122*a*). That is, end area 121*a* overlaps end area 121*b*, and end area 122*b* overlaps end area 122*a*. Each of sections 110*a* and 110*b* include, therefore, an exposed area and an overlapped area. Accordingly, first section 110*a* and second section 110*b* overlap each other in the areas of concave edges 120*a* and 120*b*.

When first section 110*a* and second section 110*b* are placed in the mutually overlapping configuration discussed above, central areas 123*a* and 123*b* may form an aperture 140 between each of first section 110*a* and second section 110*b*. The dimensions of aperture 140 (i.e., the size of the opening formed by first section 110*a* and second section 110*b*) primarily depend upon the relative locations of central areas 123*a* and 123*b*, and the dimensions of aperture 140 may be varied significantly depending upon the specific purpose of or application for overlapping element 100. In some embodiments, central areas 123*a* and 123*b* may contact each other such that aperture 140 is relatively small or absent.

First section 110*a* and second section 110*b* are joined to each other by a plurality of stitches 150 that extend along portions of side edges 130*a* and 130*b*. More particularly, one of stitches 150 joins one of side edges 130*a* with one of side edges 130*b*, and another of stitches 150 joins another of side edges 130*a* with another of side edges 130*b*. Accordingly, stitches 150 extend along portions of side edges 130*a* and 130*b* to join first section 110*a* and second section 110*b* to each other and to secure the positions of concave edges 120*a* and 120*b* relative to each other. In lieu of stitches 150, first section 110*a* and second section 110*b* may be joined together through an adhesive bond or a heat bond, for example. In addition, stitches 150, the adhesive bond, or the heat bond may extend inward to join interior portions of first section 110*a* and second section 110*b*. In some embodiments, stitches 150 may extend along concave edge 120*a* to join portions of concave edge 120*a* with second section 110*b*, and stitches 150 may extend along concave edge 120*b* to join portions of concave edge 120*b* with first section 110*a*. Accordingly, a variety of procedures may be employed to join first section 110*a* and second section 110*b*.

Figure 4:
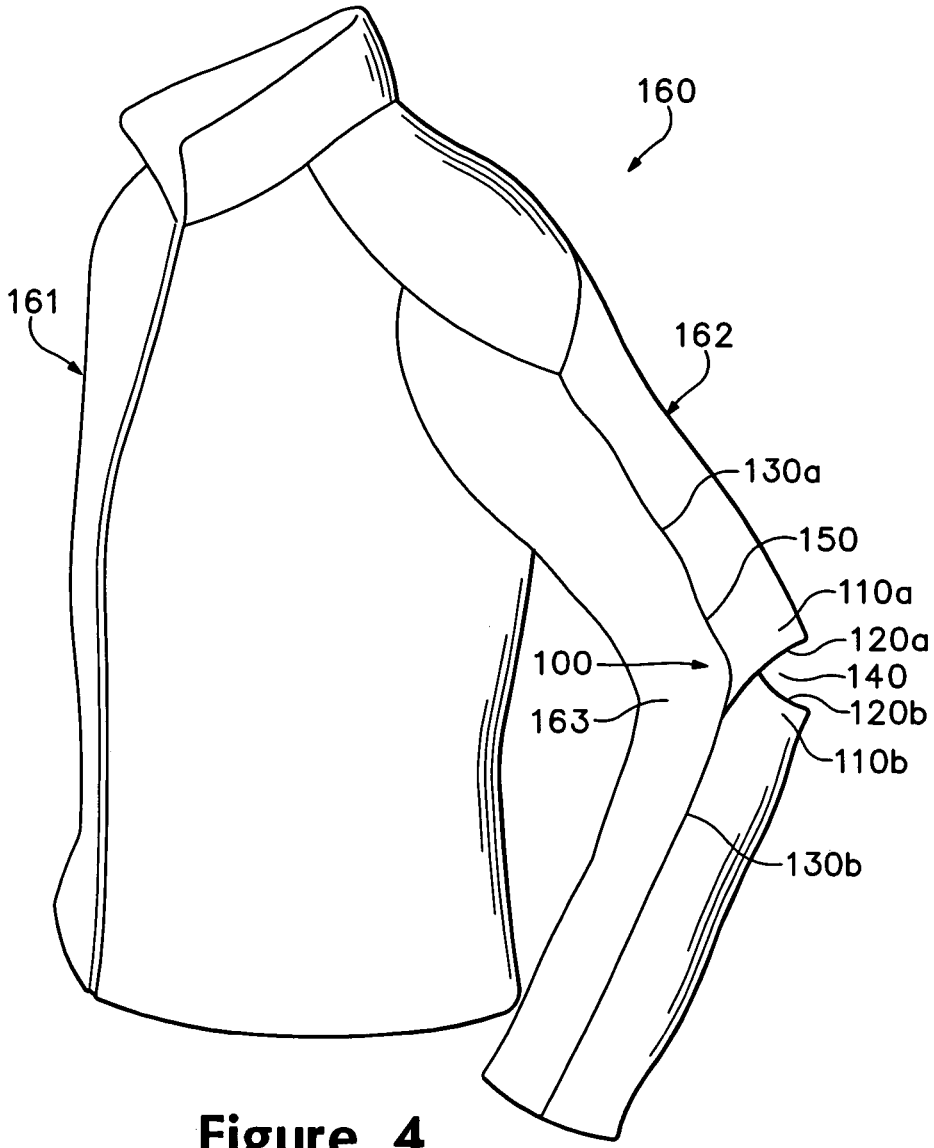
FIG. 4 is a perspective view of a first article of apparel that incorporates the first overlapping element.
Figure 5:
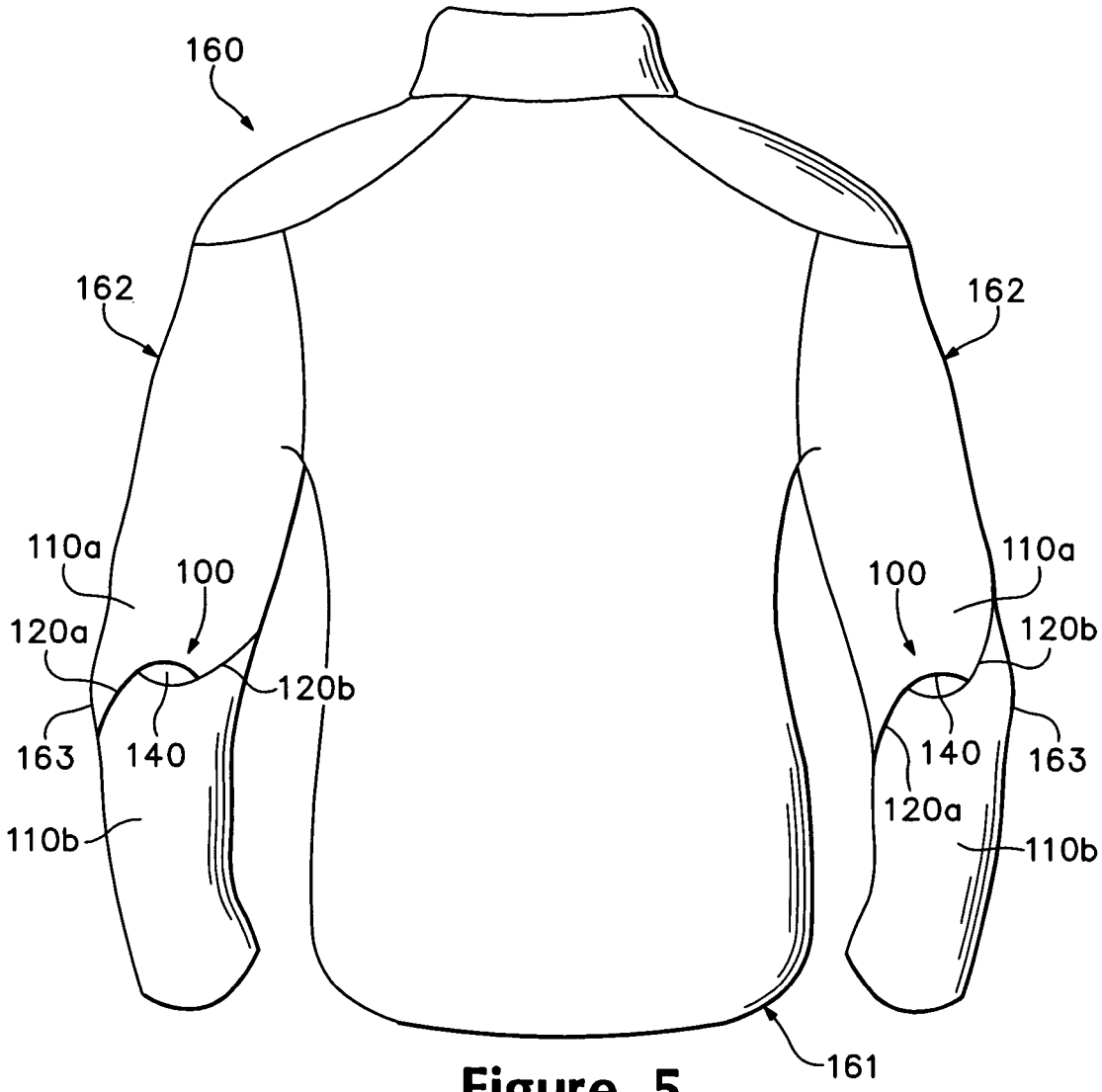
FIG. 5 is a back elevational view of the first article of apparel.

A structure having the general configuration of overlapping element 100 may be incorporated into a variety of products, including various articles of apparel and containers. With reference to FIGS. 4 and 5, one manner in which overlapping element 100 may be employed in an article of apparel 160, particularly a shirt, is disclosed. Apparel 160 includes a torso region 161 and a pair of sleeves 162. Each of sleeves 162 includes an elbow region 163. In general, elbow regions 163 correspond with the locations of elbows and are intended to bend or otherwise flex with the elbows. Accordingly, each of elbow regions 163 includes an overlapping element 100 that provides a flexible joint in elbow regions 163. In other words, one purpose for incorporating overlapping element 100 into an article of apparel is to provide a flexible joint.

Overlapping element 100 may form only the flexible joints in elbow regions 163, or overlapping element 100 may form relatively large portions of each sleeve 162. As depicted in FIGS. 4 and 5, first section 110*a* extends from a shoulder area of apparel 160 to elbow region 163, and second section 110*b* extends from a wrist area of apparel 160 to elbow region 163. Accordingly, overlapping element 100 may form a relatively significant portion of each sleeve 162, in addition to forming a flexible joint in each of sleeves 162.

Second Overlapping Element Configuration

Figure 6:
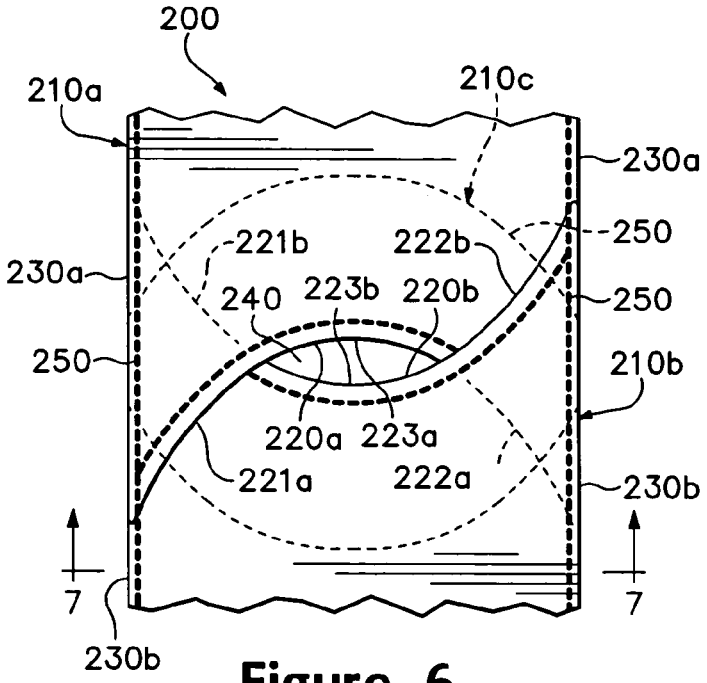
FIG. 6 is a plan view of a second overlapping element in accordance with the present invention.
Figure 7:
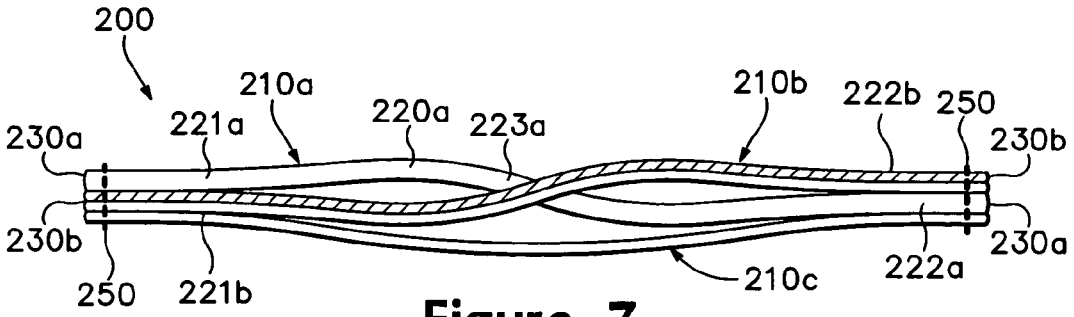
FIG. 7 is a first cross-sectional view of the second overlapping element, as defined by section line 7-7 in FIG. 6.
Figure 8:
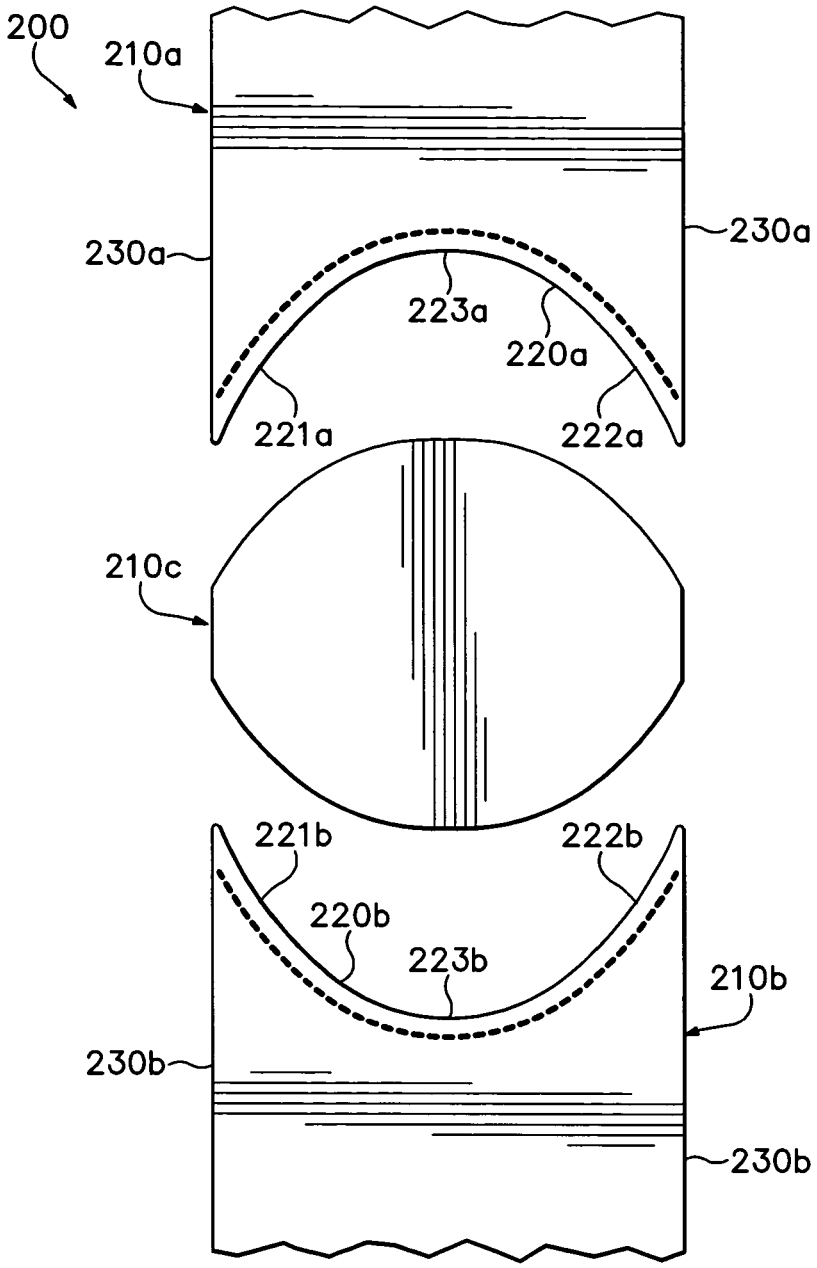
FIG. 8 is an exploded plan view of the second overlapping element.

A second overlapping element 200 is depicted in FIGS. 6-8 and has a similar general configuration as overlapping element 100. Accordingly, overlapping element 200 includes a first section 210*a* and a second section 210*b* that are each formed from a two-dimensional material placed in a mutually overlapping configuration. As with overlapping element 100, an aperture 240 is formed between first section 210*a* and second section 210*b* (i.e., between concave edges 220*a* and 220*b*). In contrast with overlapping element 100, however, overlapping element 200 also includes an insert section 210*c* that extends across aperture 240.

First section 210*a* includes a concave edge 220*a* and a pair of side edges 230*a*. At least a portion of concave edge 220*a* exhibits a concave configuration that effectively forms a depression in first section 210*a*. Concave edge 220*a* includes an end area 221*a*, another end area 222*a* that is positioned opposite end area 221*a*, and a central area 223*a* that is positioned between end areas 221*a* and 222*a*. Side edges 230*a* extend away from concave edge 220*a* to effectively form sides of first section 210*a*. Second section 210*b* exhibits a configuration that is substantially similar to first section 210*a*. Accordingly, second section 210*b* includes a concave edge 220*b* and a pair of side edges 230*b*. Concave edge 220*b* includes an end area 221*b*, another end area 222*b* that is positioned opposite end area 221*b*, and a central area 223*b* that is positioned between end areas 221*b* and 222*b*. Side edges 230*b* extend away from concave edge 220*b* to effectively form sides of second section 210*b*.

As with overlapping element 100, overlapping element 200 is formed such that first section 210*a* and second section 210*b* overlap each other. Referring to FIGS. 6-8, a portion of first section 210*a* overlaps a portion of second section 210*b*, and another portion of second section 210*b* overlaps another portion of first section 210*a*. More particularly, end area 221*a* overlaps end area 221*b*, and end area 222*b* overlaps end area 222*a*. Accordingly, first section 210*a* and second section 210*b* overlap each other in the areas of concave edges 220*a* and 220*b*.

When first section 210*a* and second section 210*b* are placed in the mutually overlapping configuration discussed above, central areas 223*a* and 223*b* form aperture 240 between each of first section 210*a* and second section 210*b*. Insert section 210*c* extends across aperture 240 and is secured to each of first section 210*a* and second section 210*b*. Insert section 210*c* has a generally circular shape, but may have any other practical shape within the scope of the present invention. In general, however, insert section 210*c* will be shaped to extend over aperture 240. In some embodiments, insert section 210*c* may be positioned behind first section 210*a* and second section 210*b* such that only a portion of insert section 210*c* is visible through aperture 240. In other embodiments, insert section 210*c* may be placed in front of first section 210*a* and second section 210*b* or between first section 210*a* and second section 210*b*.

First section 210*a* and second section 210*b* are joined to each other by a plurality of stitches 250 that extend along portions of side edges 230*a* and 230*b*. More particularly, one of stitches 250 joins one of side edges 230*a* with one of side edges 230*b*, and another of stitches 250 joins another of side edges 230*a* with another of side edges 230*b*. Accordingly, stitches 250 extend along portions of side edges 230*a* and 230*b* to join first section 210*a* and second section 210*b* to each other and to secure the positions of concave edges 220*a* and 220*b* relative to each other. In lieu of stitches 250, first section 210*a* and second section 210*b* may be joined together through an adhesive bond or a heat bond, for example. As depicted in the figures, insert section 210*c* has a generally circular shape and extends to side edges 230*a* and 230*b*, and stitches 250 join insert section 210*c* to overlapping element 200. In some embodiments, however, a plurality of stitches may extend around insert section 210*c* to join insert section 210*c* to each of first section 210*a* and second section 210*b*.

Figure 9:
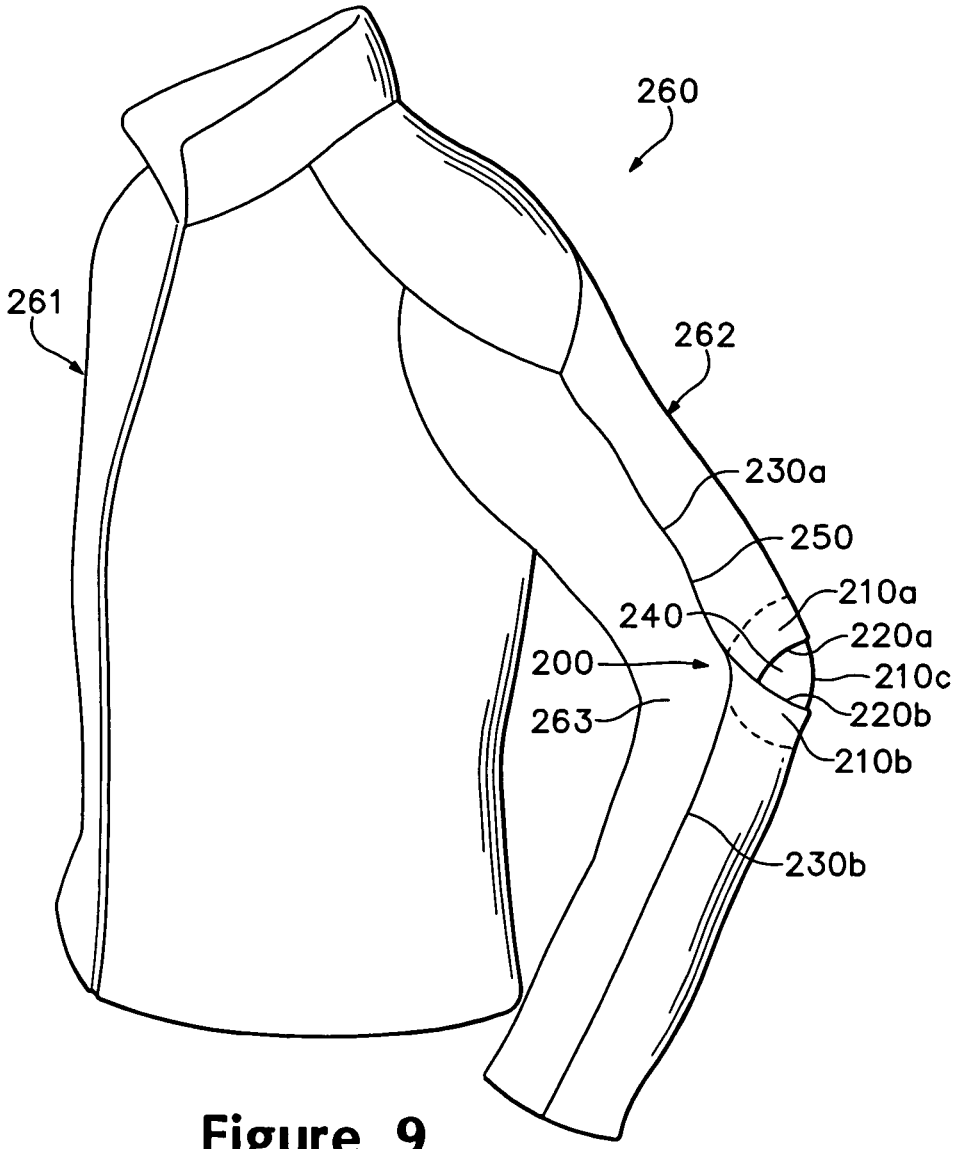
FIG. 9 is a perspective view of a second article of apparel that incorporates the second overlapping element.
Figure 10:
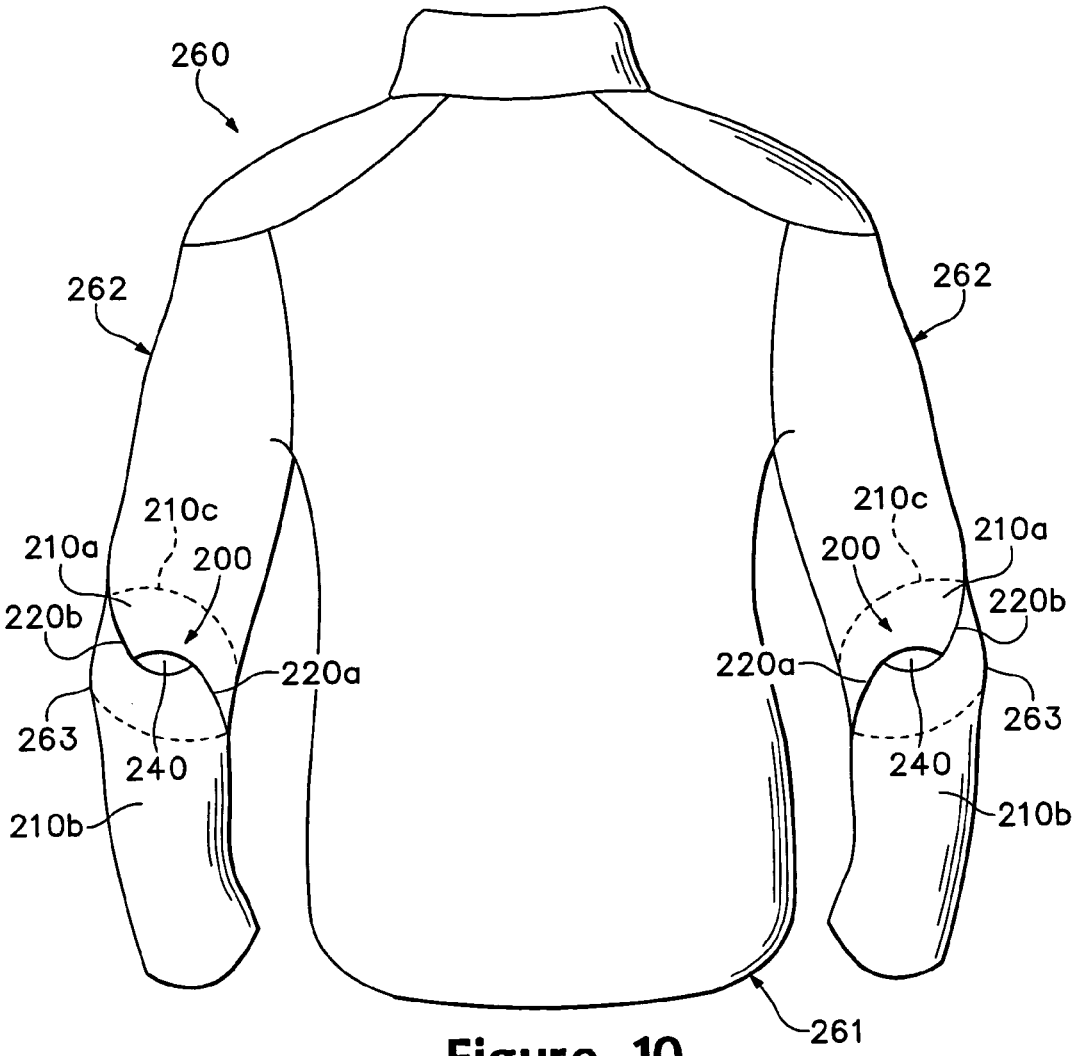
FIG. 10 is a back elevational view of the second article of apparel.

With reference to FIGS. 9 and 10, one manner in which overlapping element 200 may be employed in an article of apparel 260, particularly a shirt, is disclosed. Apparel 260 has the general configuration of apparel 160 and includes a torso region 261 and a pair of sleeves 262. Each of sleeves 262 includes an elbow region 263, and each of elbow regions 263 include an overlapping element 200 that provides a flexible joint in elbow regions 263. Aperture 140 in overlapping element 100 formed an opening in apparel 160. In contrast with apparel 160, insert section 210*c* extends across aperture 240 to cover the opening. Accordingly, insert section 210*c* effectively covers the opening formed by aperture 140.

Third Overlapping Element Configuration

Figure 11:
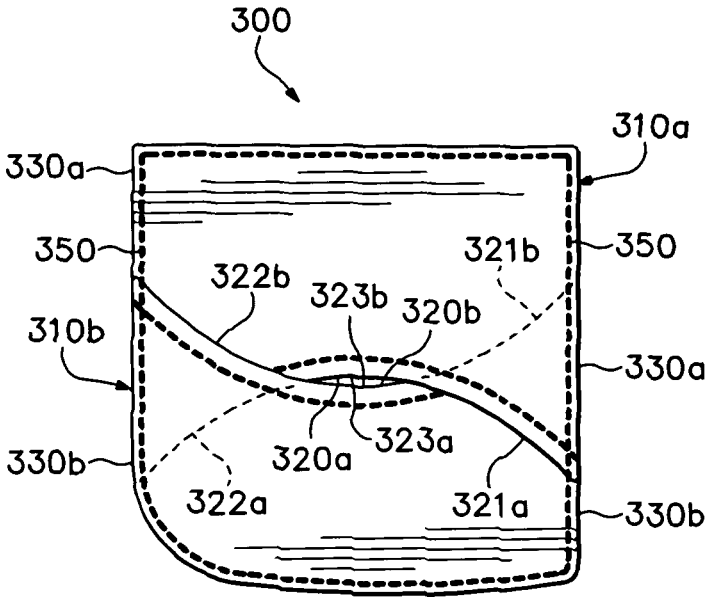
FIG. 11 is a plan view of a third overlapping element in accordance with the present invention.
Figure 12:
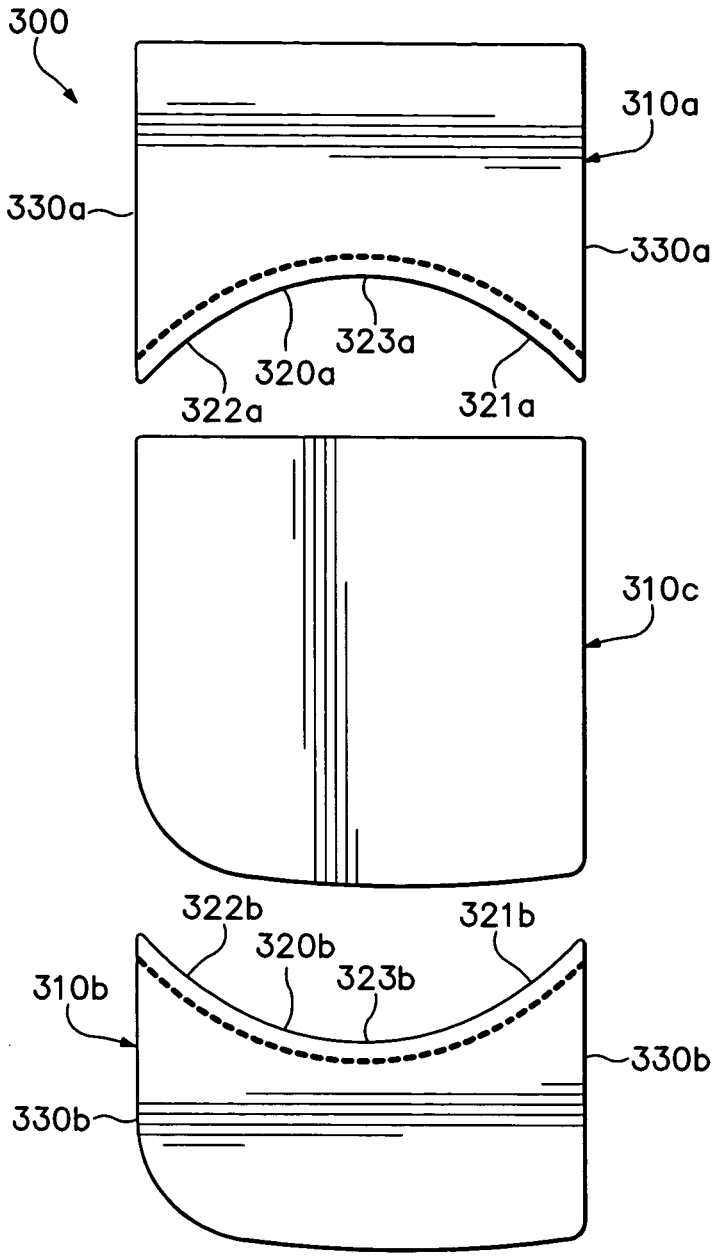
FIG. 12 is an exploded plan view of the third overlapping element.
Figure 13:
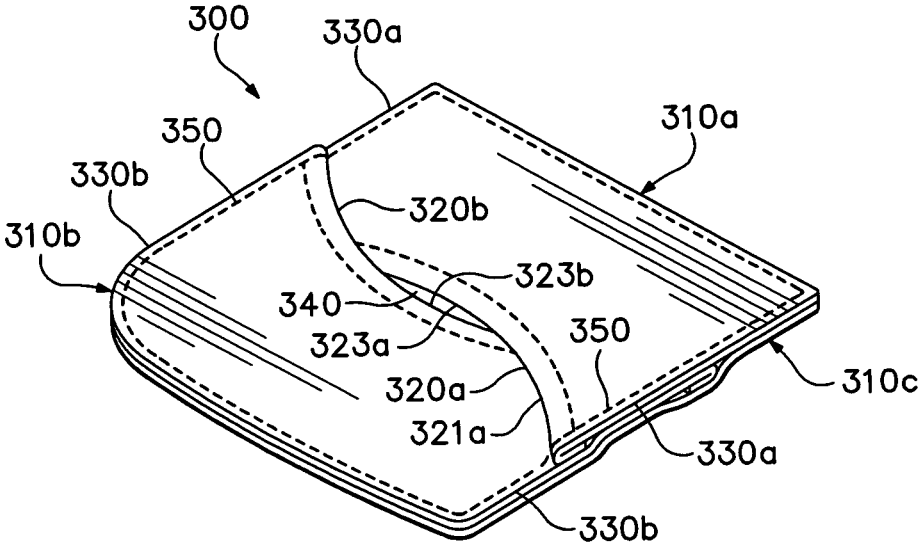
FIG. 13 is a perspective view of the third overlapping element.

A third overlapping element 300 that is suitable for forming a pocket in either apparel or a container is depicted in FIGS. 11-13. Overlapping element 300 includes a first section 310*a* and a second section 310*b* that are each formed from a two-dimensional material placed in a mutually overlapping configuration. First section 310*a* includes a concave edge 320*a* and a pair of side edges 330*a*. At least a portion of concave edge 320*a* exhibits a concave configuration that effectively forms a depression in first section 310*a*. Concave edge 320*a* includes an end area 321*a*, another end area 322*a* that is positioned opposite end area 321*a*, and a central area 323*a* that is positioned between end areas 321*a* and 322*a*. Side edges 330*a* extend away from concave edge 320*a* to effectively form sides of first section 310*a*. Second section 310*b* exhibits a configuration that is substantially similar to first section 310*a*. Accordingly, second section 310*b* includes a concave edge 320*b* and a pair of side edges 330*b*. Concave edge 320*b* includes an end area 321*b*, another end area 322*b* that is positioned opposite end area 321*b*, and a central area 323*b* that is positioned between end areas 321*b* and 322*b*. Side edges 330*b* extend away from concave edge 320*b* to effectively form sides of second section 310*b*.

As with overlapping elements 100 and 200, overlapping element 300 is formed such that first section 310*a* and second section 310*b* overlap each other. Referring to FIGS. 11-13, a portion of first section 310*a* overlaps a portion of second section 310*b*, and another portion of second section 310*b* overlaps another portion of first section 310*a*. More particularly, end area 321*a* overlaps end area 321*b*, and end area 322*b* overlaps end area 322*a*. Accordingly, first section 310*a* and second section 310*b* overlap each other in the areas of concave edges 320*a* and 320*b*.

In addition to first section 310*a* and second section 310*b*, overlapping element 300 includes a backing section 310*c* with the same overall dimensions of overlapping element 300. First section 310*a* and second section 310*b* are joined to each other by a plurality of stitches 350 that extend along portions of side edges 330*a* and 330*b* and extend around overlapping element 300. Stitches 350 also join backing section 310*c* to first section 310*a* and second section 310*b* around the periphery of overlapping element 300. Whereas stitches 350 extend around the periphery of overlapping element 300, stitches 350 are not located in the interior of overlapping element 300. Accordingly, backing section 310*c* is not secured to either first section 310*a* or second section 310*b* in the interior of overlapping element 300. A space or open area is formed, therefore, between backing section 310*c* and both of first section 310*a* or second section 310*b*, and access to the space may be gained through an aperture 340, which is formed between central areas 323*a* and 323*b*. Aperture 340 forms an access opening, and objects may be placed within overlapping element 300 through aperture 340. Whereas apertures 140 and 240 may be relatively large, aperture 340 may be relatively small to prevent objects from being inadvertently removed from (i.e., falling from) overlapping element 300.

Figure 14:
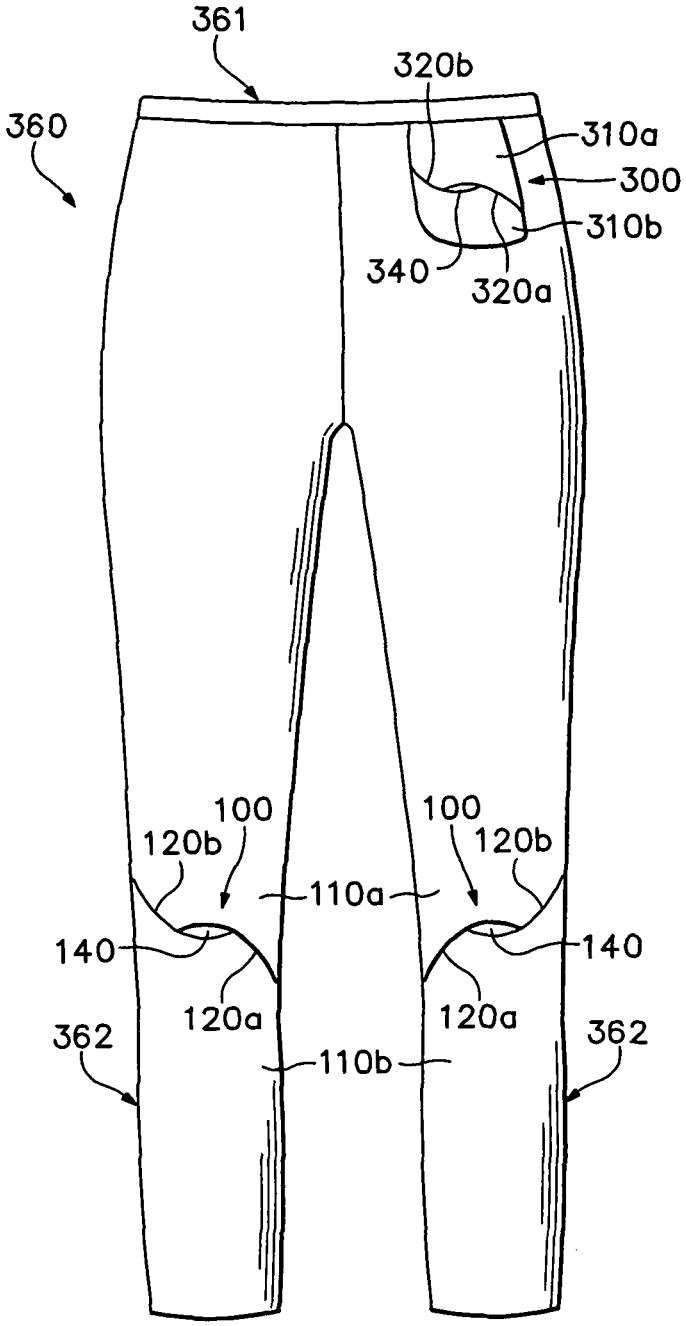
FIG. 14 is a front elevational view of a third article of apparel that incorporates the third overlapping element.

With reference to FIG. 14, one manner in which overlapping element 300 may be employed in an article of apparel 360, particularly a pair of pants, is disclosed. Apparel 360 has a pelvic region 361 and a pair of leg regions 362. Overlapping element 300 is incorporated into pelvic region 361 at a location that corresponds with the location of a conventional pocket. Accordingly, overlapping element 300 may be incorporated into articles of apparel to form a pocket within the apparel.

Overlapping elements 100 and 200 were disclosed above as being suitable for joints in elbow regions of shirts. In addition, either of overlapping elements 100 and 200 may form joints in knee areas of apparel 360. With reference to FIG. 14, a pair of overlapping elements 100 are incorporated into leg regions 362 to enhance the flexibility in portions of leg regions 362 that correspond with the positions of the knees.

Figure 15:
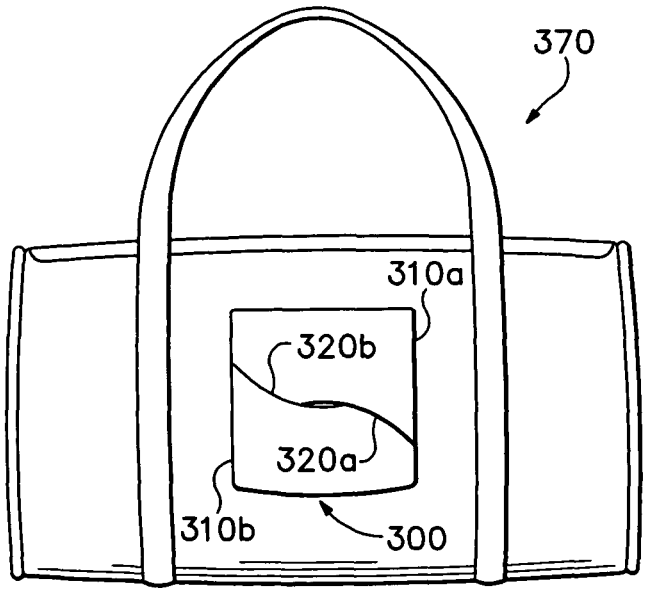
FIG. 15 is a side elevational view of a container that incorporates the third overlapping element.
Figure 16:
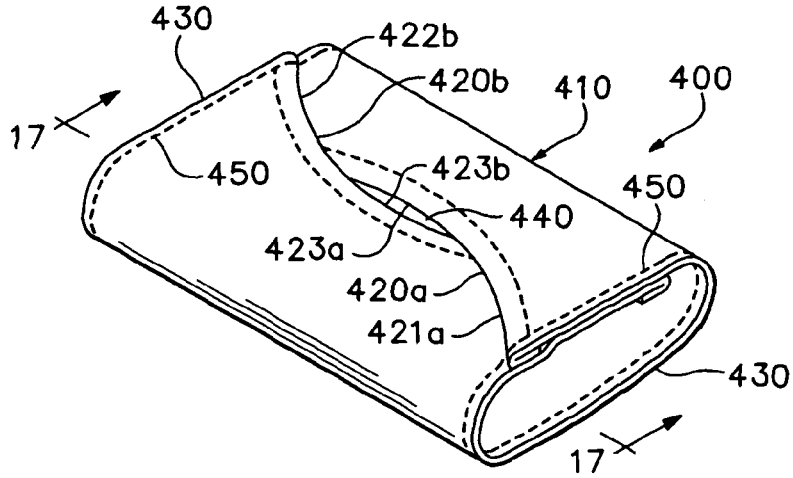
FIG. 16 is a perspective view of a fourth overlapping element in accordance with the present invention.
Figure 17:
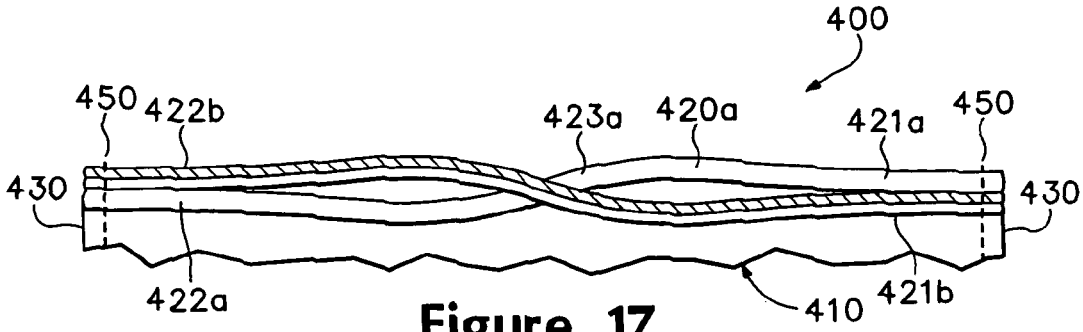
FIG. 17 is a first cross-sectional view of the fourth overlapping element, as defined by section line 17-17 in FIG. 16.
Figure 18:
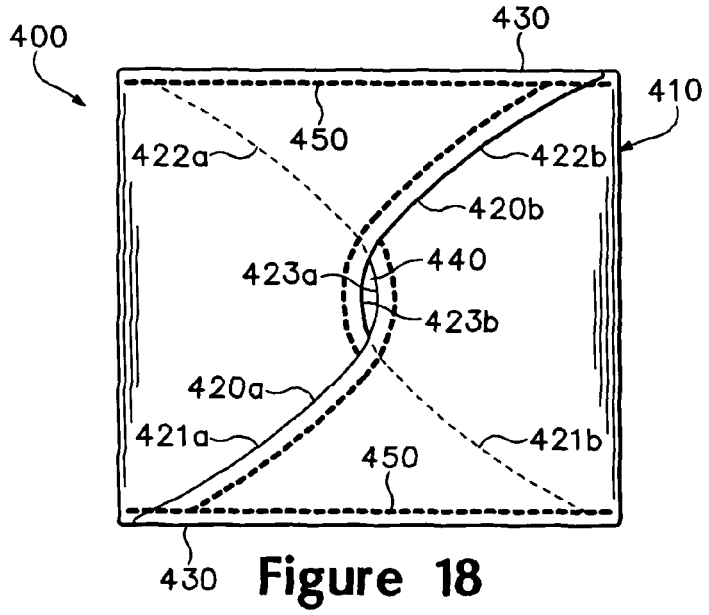
FIG. 18 is a plan view of the fourth overlapping element.
Figure 19:
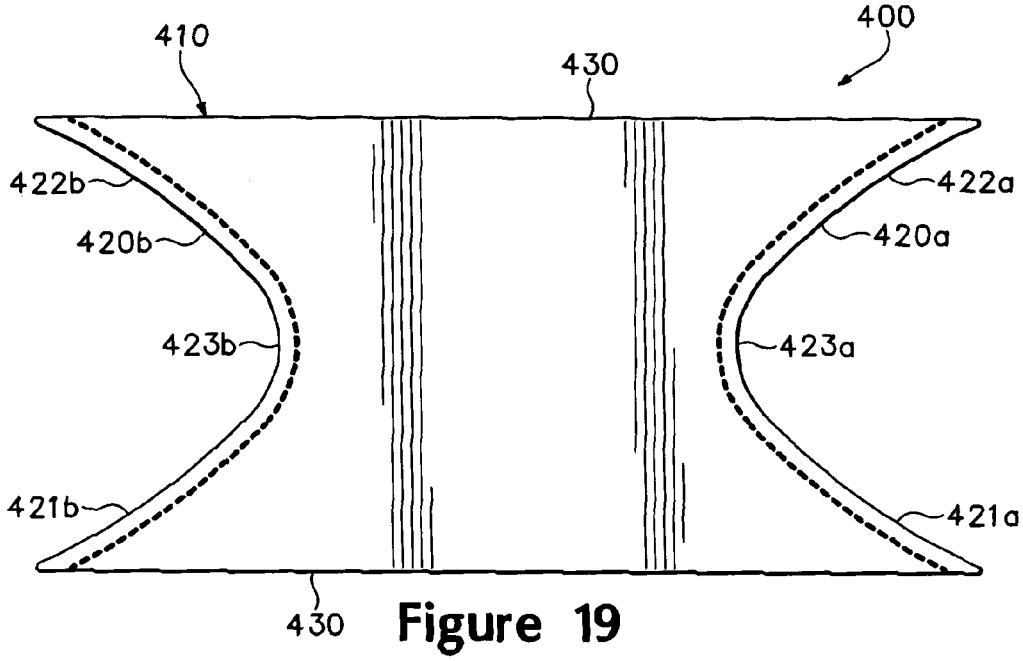
FIG. 19 is a plan view of a material section that forms the fourth overlapping element.

With reference to FIG. 15 a container 370 having the configuration of a duffel bag is disclosed. Conventional pockets in duffel bags are formed by zippered openings, for example. In contrast with the conventional duffel bag, an overlapping element 300 is incorporated into a side of container 370 to form a pocket for receiving objects. Overlapping element 300 may also be incorporated into a variety of other types of containers, such as a backpack or a hand bag, for example.

Fourth Overlapping Element Configuration

Each of overlapping elements 100, 200, and 300 are formed from at least two sections of material. For example, overlapping element 100 includes first section 110*a* and second section 110*b*. Referring to FIGS. 16-19, an overlapping element 400 is depicted that includes a single section 410 formed from a two-dimensional material. Section 410 includes a pair of opposite concave edges 420*a* and 420*b* and a pair of opposite side edges 430. Concave edge 420*a* has a generally curved shape, but may also have an angular shape within the scope of the present invention. Concave edge 420*a* may, therefore, form a triangular or rectangular depression, for example, in section 410. Accordingly, the specific shape of concave edge 420*a* may vary significantly to encompass a variety of generally concave configurations, whether curved or angular. Concave edge 420*a* includes an end area 421*a*, another end area 422*a* that is positioned opposite end area 421*a*, and a central area 423*a* that is positioned between end areas 421*a* and 422*a*. End areas 421*a* and 422*a* are each located adjacent one of side edges 430, but may also be spaced inward from side edges 430. Side edges 430 extend away from concave edge 420*a* to effectively form sides of section 410, and side edges extend between concave edges 420*a* and 420*b*.

Concave edge 420*b* exhibits a concave configuration that effectively forms another depression in section 410. The specific shape of concave edge 420*b* may be the same as concave edge 420*a*, or the shape may be different. Concave edge 420*b* includes an end area 421*b*, another end area 422*b* that is positioned opposite end area 421*b*, and a central area 423*b* that is positioned between end areas 421*b* and 422*b*. End areas 421*b* and 422*b* are each located adjacent one of side edges 430, but may also be spaced inward from side edges 430.

Overlapping element 400 is formed such that the areas of section 410 that form concave edges 420*a* and 420*b* overlap each other. In order to overlap concave edges 420*a* and 420*b*, section 410 is folded back upon itself to form a generally cylindrical structure. More particularly, section 410 is folded back such that portions of the two-dimensional material adjacent concave edge 420*a* and concave edge 420*b* are arranged to contact and overlap each other. That is, section 410 is folded back such that a portion of concave edge 420*a* (i.e., end area 421*a*) overlaps a portion of concave edge 420*b* (i.e., end area 421*b*), and another portion of concave edge 420*b* (i.e., end area 422*b*) overlaps another portion of concave edge 420*a* (i.e., end area 422*a*). Accordingly, end area 421*a* overlaps end area 421*b*, and end area 422*b* overlaps end area 422*a*. When the areas of section 410 that form concave edges 420*a* and 420*b* overlap each other, central areas 423*a* and 423*b* may form an aperture 440 between each of concave edges 420*a* and 420*b*.

In order to secure overlapping element 400 in the generally cylindrical structure, side edges 430 are stitched or otherwise secured to themselves. Each of side edges 430 includes a portion that is adjacent to concave edge 420*a* and an opposite portion that is adjacent to concave edge 420*b*. When section 410 is folded back upon itself, the portion that is adjacent to concave edge 420*a* is positioned next to the portion that is adjacent to concave edge 420*b*. With regard to each of side edges 430, these portions may then be joined together with a plurality of stitches 450. In lieu of stitches 450, an adhesive bond or a heat bond, for example, may be utilized.

Figure 20:
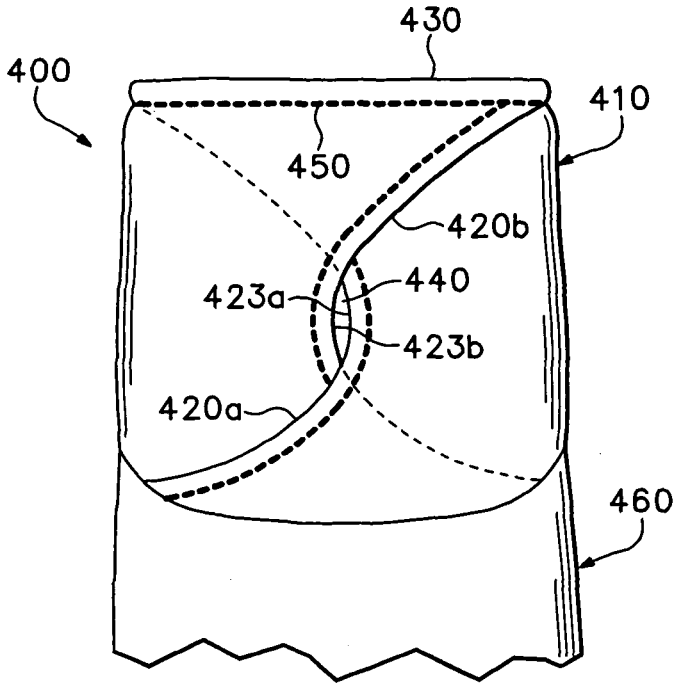
FIG. 20 is a plan view of a portion of a fourth article of apparel that incorporates the fourth overlapping element.
Figure 21:
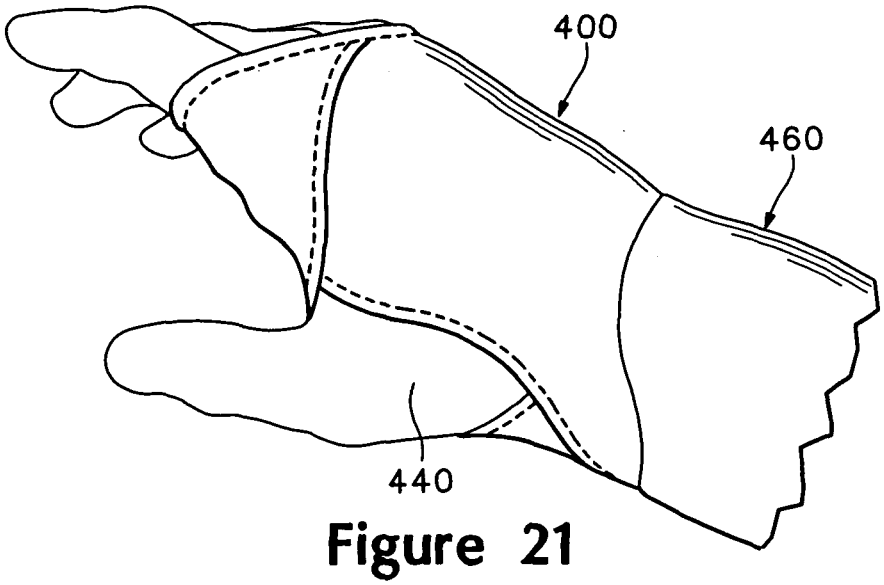
FIG. 21 is a perspective view of the fourth article of apparel and a hand received by the fourth article of apparel and the fourth overlapping element.

A structure having the general configuration of overlapping element 400 may be incorporated into a variety of products, including various articles of apparel. An arm portion of an article of apparel 460, particularly a jacket, is disclosed in FIGS. 20 and 21. Overlapping element 400 is secured to an end of the arm portion such that the hand may extend through the generally cylindrical structure formed by overlapping element 400. More particularly, a first digit of the hand (i.e., the thumb) may extend through aperture 440, the second through fifth digits (i.e., the index, middle, ring, and little fingers) may extend through an end, and the wrist extends through an opposite end that is secured to apparel 460. An advantage of this configuration is that overlapping element 400 provides insulation to the palm of the hand and limits the quantity of external air that may enter apparel 460 through the arm portion. If a glove is worn in combination with apparel 460 and overlapping element 400, then overlapping element 400 may be utilized to effectively prevent snow or water, for example, from entering apparel 460 through the arm portion.

Conclusion

The above discussion and accompanying figures disclose various overlapping element configurations that may be incorporated into an article of apparel or a container, for example. In general, the overlapping elements have at least two concave edges that overlap each other to form, for example, a flexible joint or a pocket in the article of apparel. In addition, the overlapping elements may be incorporated into a container (i.e., a backpack, hand bag, or duffel bag) to form a pocket. Accordingly, the overlapping elements may be incorporated into a variety of products.

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

That which is claimed is:

1. An element formed from at least one two-dimensional material, the element comprising a first edge and a second edge that each exhibits a concave configuration, portions of the material adjacent the first edge and the second edge being arranged to overlap each other such that a portion of the first edge overlaps a portion of the second edge, and another portion of the second edge overlaps another portion of the first edge, and wherein non-overlapping portions of the first edge and second edge form an aperture when the element is in a flexed and unflexed configuration.

2. The element recited in claim 1, wherein the first edge is formed in a first section of the at least one two-dimensional material, and the second edge is formed in a second section of the at least one two-dimensional material, the first section and the second section being separate from each other.

3. The element recited in claim 2, wherein a pair of first side edges extends from the first edge and a pair of second side edges extends from the second edge, the first side edges being joined with the second side edges.

4. The element recited in claim 1, wherein the element forms a portion of an article of apparel.

5. The element recited in claim 4, wherein the portion of the article of apparel is a flexible joint.

6. The element recited in claim 5, wherein the flexible joint is one of an elbow region and a knee region.

7. The element recited in claim 1, wherein the at least one two-dimensional material is a polymer sheet.

8. The element recited in claim 1, wherein the at least one two-dimensional material is a textile.

9. The element recited in claim 8, wherein the textile exhibits one-directional stretch.

10. The element recited in claim 8, wherein the textile exhibits multi-directional stretch.

11. The element recited in claim 1, wherein the concave configuration of the first edge and the second edge are curved indentations in the at least one two-dimensional material that form the first edge and the second edge.

12. The element recited in claim 1, wherein the concave configuration of the first edge and the second edge are angular indentations in the at least one two-dimensional material that form the first edge and the second edge.

13. An article of apparel incorporating an element formed from at least one two-dimensional material, the element comprising:

a first edge with a concave configuration, the first edge having a pair of end areas that include a first exposed end area and an opposite first overlapped end area; and a second edge with a concave configuration, the second edge having a pair of end areas that include a second exposed end area and an opposite second overlapped end area, portions of the material adjacent the first edge and the second edge being arranged to overlap each other such that the first exposed end area of the first edge overlaps the second overlapped end area of the second edge, and the second exposed end area of the second edge overlaps the first overlapped end area of the first edge; and non-overlapping portions of the first edge and the second edge define an aperture in a flexed and unflexed configuration.

14. The article of apparel recited in claim 13, wherein the element forms a flexible joint.

15. The article of apparel recited in claim 14, wherein the flexible joint is one of an elbow region and a knee region of the article of apparel.

16. The article of apparel recited in claim 13, wherein the at least one two-dimensional material is a polymer sheet.

17. The article of apparel recited in claim 13, wherein the at least one two-dimensional material is a textile.

18. The article of apparel recited in claim 17, wherein the textile exhibits one-directional stretch.

19. The article of apparel recited in claim 17, wherein the textile exhibits multi-directional stretch.

20. The article of apparel recited in claim 13, wherein the first edge is formed in a first section of the at least one two-dimensional material, and the second edge is formed in a second section of the at least one two-dimensional material, the first section and the second section being separate from each other.

21. The article of apparel recited in claim 20, wherein a pair of first side edges extends from the first edge and a pair of second side edges extends from the second edge, the first side edges being joined with the second side edges.

22. The article of apparel recited in claim 13, wherein the concave configuration of the first edge and the second edge are curved indentations in the at least one two-dimensional material that form the first edge and the second edge.

23. The article of apparel recited in claim 13, wherein the concave configuration of the first edge and the second edge are angular indentations in the at least one two-dimensional material that form the first edge and the second edge.

* * * * *